US005409197A

United States Patent [19]

Davis

[11] Patent Number: 5,409,197

[45] Date of Patent: Apr. 25, 1995

[54] COOLING MEMBER FOR BLAST FURNACE TAP OPENING

[76] Inventor: Michael Davis, 7901 E. 900 South - 92, Roanoke, Ind. 46783

[21] Appl. No.: 14,496

[22] Filed: Feb. 8, 1993

[51] Int. Cl.[6] ..... B22D 41/005

[52] U.S. Cl. ..... 266/46; 266/236; 222/592

[58] Field of Search ..... 266/46, 236, 191; 222/592

[56] References Cited

U.S. PATENT DOCUMENTS

| | | | |
|---|---|---|---|
| 244,454 | 7/1881 | Hartman | 266/191 |
| 518,495 | 7/1894 | Fellows | 266/191 |
| 922,304 | 5/1909 | Marsden et al. | 266/191 |
| 952,284 | 3/1910 | De St. Seine | 266/191 |
| 2,409,337 | 10/1946 | Yuhas | 266/191 |
| 2,476,889 | 7/1949 | Mohr, Jr. et al. | 266/191 |
| 2,492,269 | 12/1949 | Comer, Jr. | 266/191 |
| 2,918,754 | 12/1959 | Plumer | 266/236 |
| 3,450,396 | 7/1969 | Pantke et al. | 266/191 |
| 4,230,307 | 10/1980 | Philip | 266/46 |
| 4,271,993 | 6/1981 | Anderson | 266/191 |
| 4,407,489 | 10/1983 | Oberndorfer | 266/191 |
| 4,498,610 | 2/1985 | Wooding | 222/592 |
| 4,724,985 | 2/1988 | Dessar | 222/592 |
| 4,750,649 | 6/1988 | Fahey et al. | 222/592 |
| 5,040,773 | 8/1991 | Hackman | 222/592 |

FOREIGN PATENT DOCUMENTS 1222679 7/1984 U.S.S.R. .

*Primary Examiner*—Scott Kastler
*Attorney, Agent, or Firm*—Ronald P. Kananen

[57] ABSTRACT

A cooling member for positioning in the refractory wall of a cupola at a location spaced from a tap-hole has a heat-conductive member, such as a copper plate, in contact with a fluid-conducting member, such as a copper conduit. The cooling member is bent to form an L-shaped member, so that a pair of such members defines a channel at the tap-hole location. Refractory is provided on each side of the L-shaped member and forms the tap-hole on the interior within the channel thus formed. Alternative shapes for the cooling member are disclosed.

12 Claims, 8 Drawing Sheets

COOLING MEMBER FOR BLAST FURNACE TAP OPENING

FIELD OF THE INVENTION

This invention relates to a cooling member for a tap-opening in a blast furnace. More particularly, this invention relates to a water-cooled heat conductive member positioned relative to a blast furnace tap hole for extracting heat from the tap area to reduce tap-hole erosion. Still more particularly, this invention relates to a heat conductive member, such as a copper plate, having water circulating channels on or in contact with the member, for forming a channel about the tap-hole and spacedly positioned about 6 to 12 inches from the tap-hole, thus to reduce tap-hole erosion caused by heat, hot air, and mechanical and chemical erosion.

BACKGROUND OF THE INVENTION

A cupola is a cylindrical shaft furnace that burns coke, ore or scrap steel, and limestone, intensified by the blowing of air through tuyeres to create a molten alloy of metal such as iron. Slags are:also created along with the metal or alloy as a result of the smelting of ore. Alternate layers of ore, limestone, and coke are charged into the top of the cupola. As the ore descends, the ore is melted by direct contact with the countercurrent flow of hot gasses from the coke combustion. The resulting molten metal or alloy collects in the well of the cupola where it is discharged for use by intermittent tapping or by continuous flow.

The iron which collects in the base of the cupola travels through an opening allowing the molten metal to collect in the breast or separator of the blast furnace, where slag is skimmed from the surface of the metal, depending on whether the cupola is a conventional or a dry bottom cupola. The opening is referred to as a "tap-hole" or iron exit for the cupola.

A conventional tap-hole is formed by making a form shape, usually round or rectangular, from steel and installing refractory material around the form shape during a relining of the breast or separator in the cupola. After the first tapping of the cupola, thus opening the iron exit, the steel form melts away, but its shape is maintained by the refractory, thus identifying the tap-hole in the cupola.

In U.S. Pat. No. 2,492,269, water-cooled members for blast furnaces are described. Due to the high temperatures generated in the hearth and bosh of blast furnaces, such as are used for smelting iron ore, and the erosive action of the molten iron and slag, means are provided for cooling the furnace brickwork to prolong its life. Cooling has been provided for the furnace openings through which the blast is introduced into the hearth, and through which the molten slag is drawn off between castings in order to withstand the intense physical, thermal, and chemical action. It is there indicated that water-cooled copper or bronze castings are used for these purposes, because of its high conductivity. However, copper or bronze will not withstand long contact with the molten iron or slag, sometimes resulting in burned castings whereupon water is released into the furnace causing delays. Repair is thus time-consuming and costly.

Tap-hole deformation can be caused by, but is not limited to, the high temperatures of the molten iron, the large volumes of hot blast air, mechanical erosion, and chemical erosion. As a result of one or more of these and other possible factors, the refractory lining the cupola and the tap-hole wears out and frequently must be replaced. Typically, this replacement of the refractory at the tap-hole occurs on a daily or weekly basis. Thus, it is a costly repair item in cupola operation, but practically there are no other readily available options. Thus, it continues to be a problem to reduce or eliminate the need for such costly repair.

In U.S. Pat. No. 4,498,610, a tap-hole for a melting furnace is described as including a cylindrically-shaped copper shell having a central opening through which molten material from the furnace passes. The shell includes a reduced inner diameter portion defining an orifice and a plurality of narrow holes formed in the shell wall adjacent the orifice but isolated therefrom and interconnected to form a plurality of highly restrictive flow passages. A liquid coolant is supplied to the passages. However, such a device has a number of practical drawbacks which limit its applicability, not the least of which is that the device cannot be practically installed in a cupola from a safety standpoint. If the shell ruptures, water could potentially escape to the furnace or the pouring floor with deleterious effects. In addition, the shell, to be effective, apparently needs to form a freeze of molten material, or slag, in the orifice to serve as a liner so that the freeze results in effective cooling by the resulting skin or skull on the working surface.

Thus, it remains a continuing problem in the blast furnace art to provide a method and apparatus for reducing or eliminating a need for costly and untimely repairs of the tap-hole.

It is another continuing problem in the blast furnace art to provide a method and apparatus for prolonging the life of a cupola refractory at the tap-hole area, to reduce repairs.

It is still another continuing problem in this art to provide a water-cooled member for a cupola in a blast furnace to prolong refractory life at the tap-hole area, and to reduce the occasions for repair of the refractory at that location.

BRIEF SUMMARY OF THE INVENTION

Thus, it is an overall object of this invention to provide a fluid-cooled, heat conductive member for use in a blast furnace near the tap hole, thus to reduce tap-hole erosion.

It is an additional object of this invention to provide a plate of a solid conductive metal, such as copper, with a plurality of fluid conducting channels in contact with the plate to create a heat exchanger which is used at a position congruent with or forming a channel housing the tap-hole.

It is still another object of this invention to provide a water-cooled solid copper plate member having dimensions greater than a tap-hole, and contoured to envelop the tap-hole when located at a position spaced from said tap-hole, wherein a space between said member and said tap-hole is made from a refractory material.

It is yet another object of this invention to provide a fluid-cooled, heat conductive member shaped like a tap-hole in a blast furnace, such as round or square, and spaced therefrom by about 6 to 12 inches wherein the intermediate space is filled with refractory.

It is another object of this invention to provide a triangular member, made from three heat conductive, water-cooled plates spaced from a refractory-formed tap-hole in a blast furnace, whereby a need for repairs to the tap-hole area is reduced.

In one aspect, the invention relates to a heat conductive member, such as a solid copper plate having dimensions on the order of 28 in. by 28 in., having a length of copper tube in contact with the plate for forming a heat sink member near a tap-hole in a blast furnace. The plate, with the copper tube thereon, is bent at about its middle to form an L-shaped member. Such an L-shaped member is positioned during relining of the cupola relative to another like L-shaped member with the ends of the legs adjacent one another to form a channel in a blast furnace wall. Refractory material is provided at the outer surface of the plate where the tube is located. Refractory is also provided at the interior of the pair of L-shaped members to form a tap-hole of a desired configuration, such as round, square, triangular, or the like. Thus, the heat conducting plates are spaced from the tap hole about 6 in. to 12 in. or so.

Three flat plates of the type described could also be used to form a triangular cross-section channel to form the tap-hole at a position intermediate the three flat plates. In the alternative, the plates could be formed in a semi-circular configuration, so that a pair of such plates could form a circular cross-section channel. In still another alternative, such plates could be formed as sectors of a circle, so that a plurality of plates can form a channel in which the tap-hole is formed by refractory.

These and other features of the invention will become apparent from a review of the detailed description of the invention and the accompanying drawings.

BRIEF DESCRIPTION OF THE DRAWINGS

In the drawings:

FIG. 3A is a partial frontal cross-sectional view of the tap-hole of FIGS. 1 and 2 soon after relining the cupola taken along lines 3A—3A of FIG. 2, while

DETAILED DESCRIPTION OF THE PREFERRED EMBODIMENTS

Figure 1:
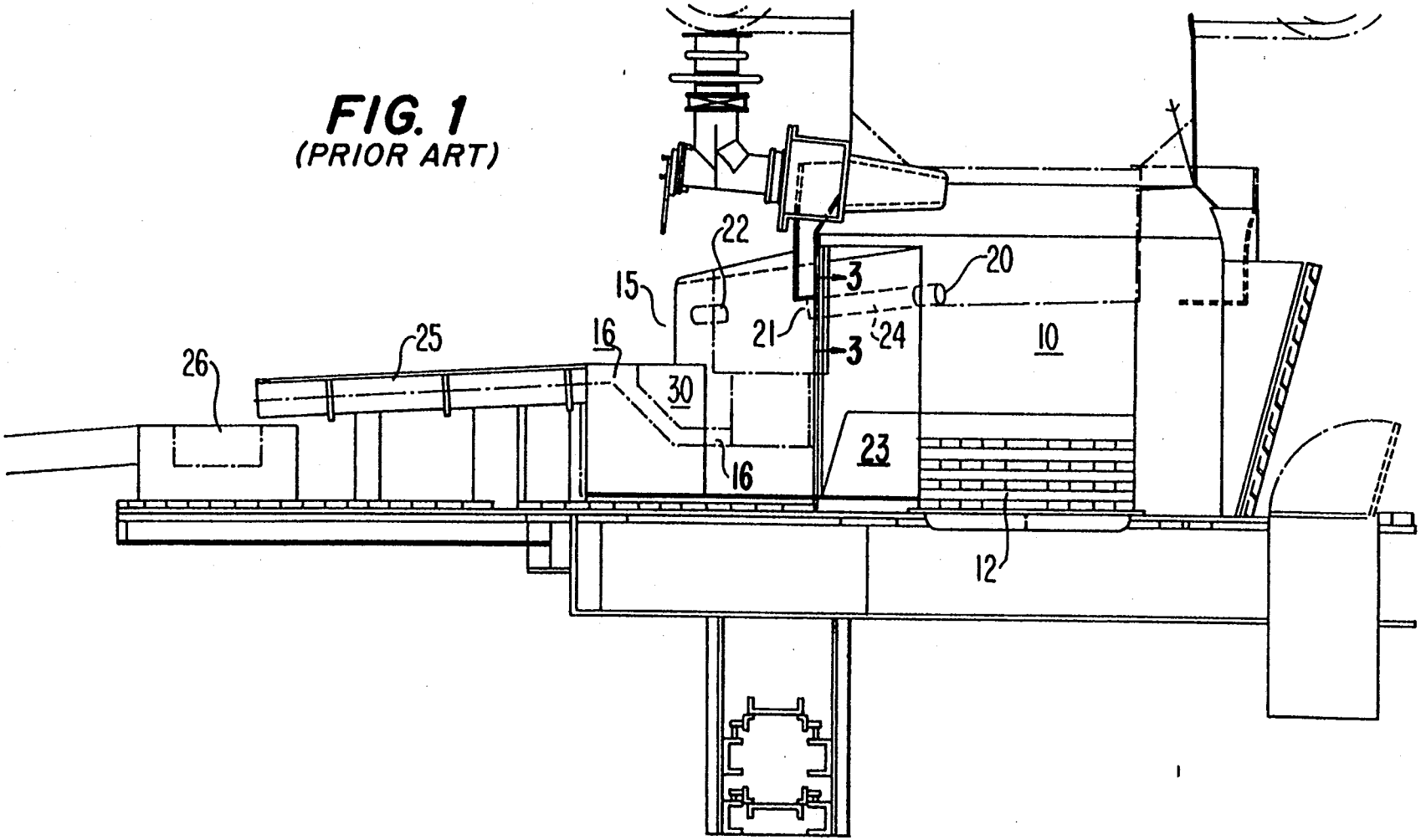
FIG. 1 (PRIOR ART)
FIG. 1 is a diagrammatic side view of a cupola and slag separator of a blast furnace in the prior art, illustrating a conventional tap-hole structure.

FIG. 1 illustrates a metal-making facility known to the prior art in which a cupola 10, such as a dry bottom cupola, includes a base 12. Molten metal or alloy and slag that accumulates in the base 12 of the cupola 10 during the smelting of iron ore exits the cupola through a tap-hole 20 and travels through an insulated tap-hole passageway 24 which is surrounded by refractory 23 (best seen in FIG. 2) to exit from the passageway 24 into a slag separator 15 at an entrance 21. The entrance 21 to the slag separator 15 is the exit from the cupola 10 at a distal end of the passageway 24 in communication with the tap-hole 20. The tap-hole 20, the passageway 24, and the exit 24 collectively will be referred to as a "tap-hole 20" unless the context of this description indicates otherwise. The slag separator 15 is integrally formed with the base 12 of the cupola 10 without external cooling.

Because the molten metal or alloy is heavier than the slag, once in the separator 15, the slag rises to the top of the metal or alloy and flows out of the separator 15 through a slag extraction opening 22 as the metal or alloy and slag flow through the separator 15. The molten metal or alloy exits the separator through a metal or alloy exit opening 16 to a runner 25 which guides the molten metal or alloy to a ladle 26. The slag extraction opening 22 is maintained at a level which is higher than the metal or alloy exit opening 16 to allow the slag to flow off the top of the metal or alloy as it flows through the separator 15. A refractory 30 lines the entire separator 15 to protect the separator and the operator from the heat of the molten metal or alloy and slag, oxidation, and chemical attack.

In the cupola 10 of the type shown in FIG. 1, erosion of the refractory occurs throughout the interior of the cupola, and especially at the tap-hole 20, due to the high temperature of the molten slag and metal, and the oxidative and chemical forces acting on the refractory. Such erosion is particularly acute at the exit 21 from the cupola 10 at the entrance to the separator 15. Thus, it is necessary in the art to reline the cupola 10 periodically with new refractory 23 to reform the tap-hole 20.

Figure 2:
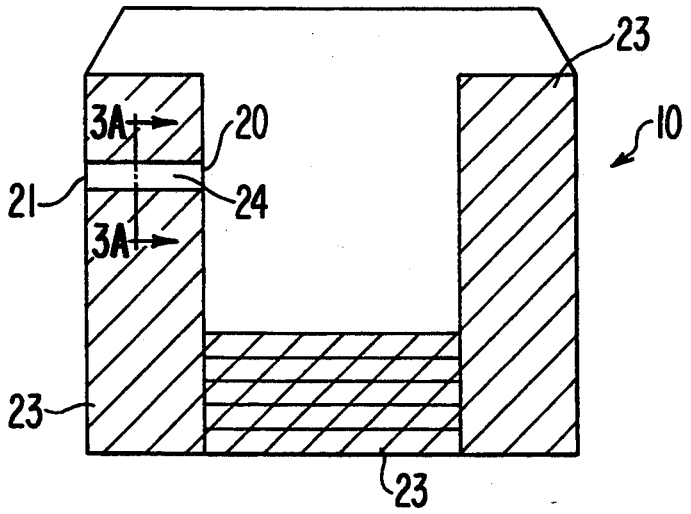
FIG. 2 (PRIOR ART)
FIG. 2 is a side cross-sectional view of the cupola of FIG. 1 taken through the tap-hole to illustrate the formation of the tap-hole in a refractory lining.

FIG. 2 shows a newly-lined cupola 10, with a formed tap-hole 20 in the refractory 23. While the particular relining techniques may vary for varying types of cupolas, basically the refractory substance, whether of brick or refractory composition, forms the tap-hole 20, the tap-hole passageway 24, and the tap-hole exit 21 (hereinafter referred to as the "tap-hole 20").

Figure 3A:
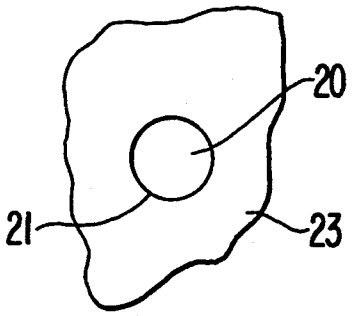
FIG. 3A (PRIOR ART)
Figure 3B:
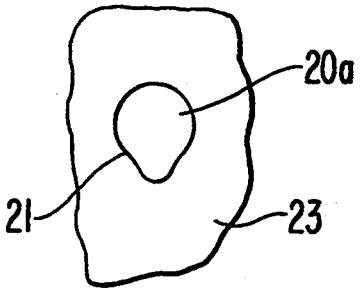
FIG. 3B (PRIOR ART)
FIGS. 3B and 3C show examples of erosion of the refractory lining at the tap-hole during use.
Figure 3C:
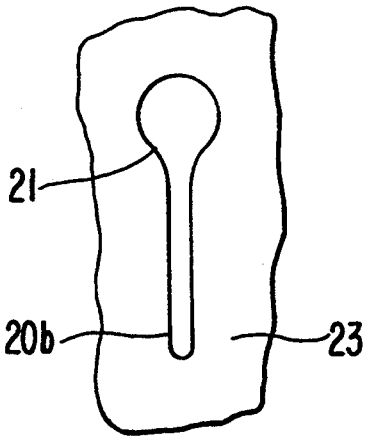
FIG. 3C (PRIOR ART)

FIG. 3A shows a partial cross-sectional view of a tap-hole 20 at its exit portion 21, as taken along the line 3A—3A of FIG. 2. As shown, the tap-hole 20 is approximately circular when the refractory is newly-lined. In use, the contour of the tap-hole 20 begins to deteriorate to form an acircular contour **20*a* as shown at FIG. 3B, leading to the cross-section as shown in FIG. 3C where the tap-hole has become elongated in the vertical direction. Such deterioration is also generally indicative of interior degradation of the refractory lining 23 within the cupola 10**.

Figure 4:
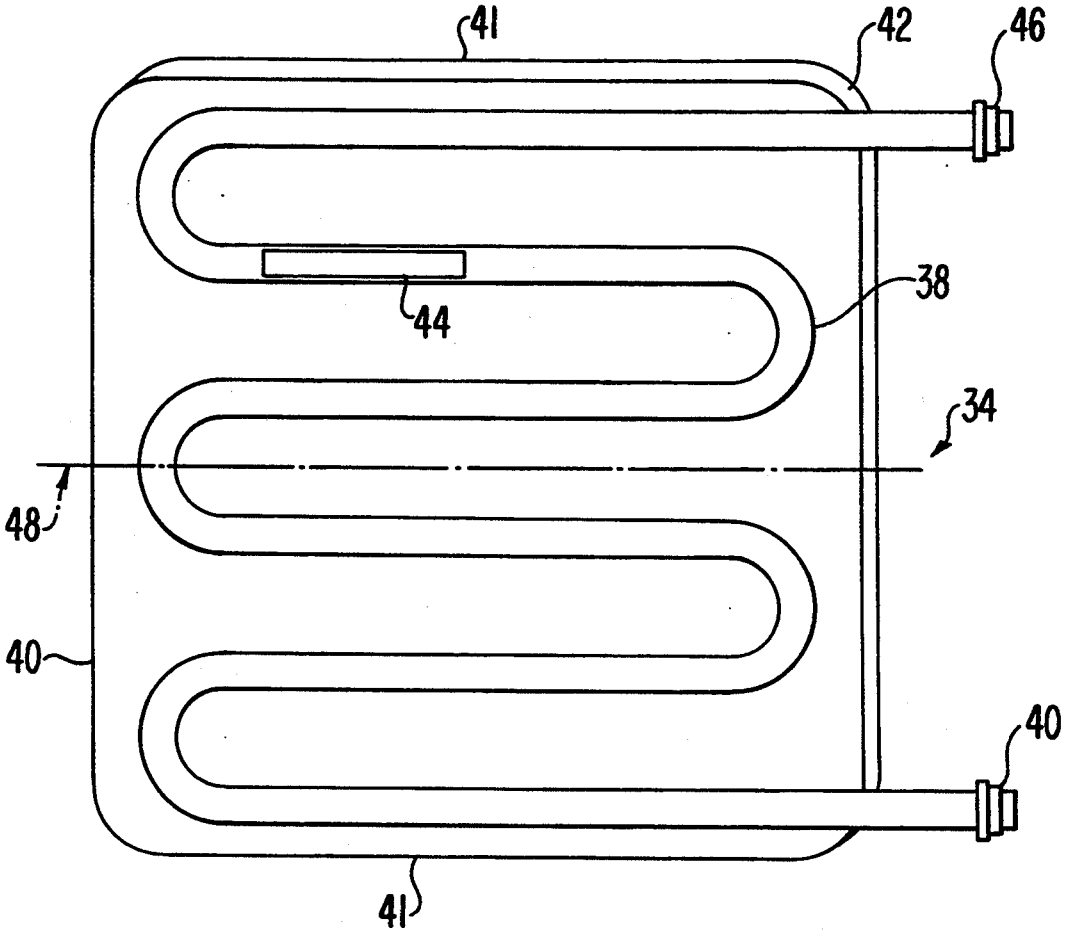
FIG. 4 is a frontal perspective view of a tap-hole cooling member according to the invention which includes a flat, heat conducting plate to which is mounted a length of heat-conductive tubing arranged in a serpentine configuration.

FIG. 4 shows the cooling member 34 according to the invention. The cooling member 34 comprises a heat conductive member 36 in contact with a fluid-conducting member 38. The heat conductive member is preferably in the form of a square or rectangular plate made from solid copper or other suitable heat-conductive material, having sides 40 and 41, and a thickness 42. By way of example, in a practical embodiment, the sides 40 and 41 are each 28 inches, while the thickness 42 is about $\frac{1}{4}$ inch.

Figure 5:
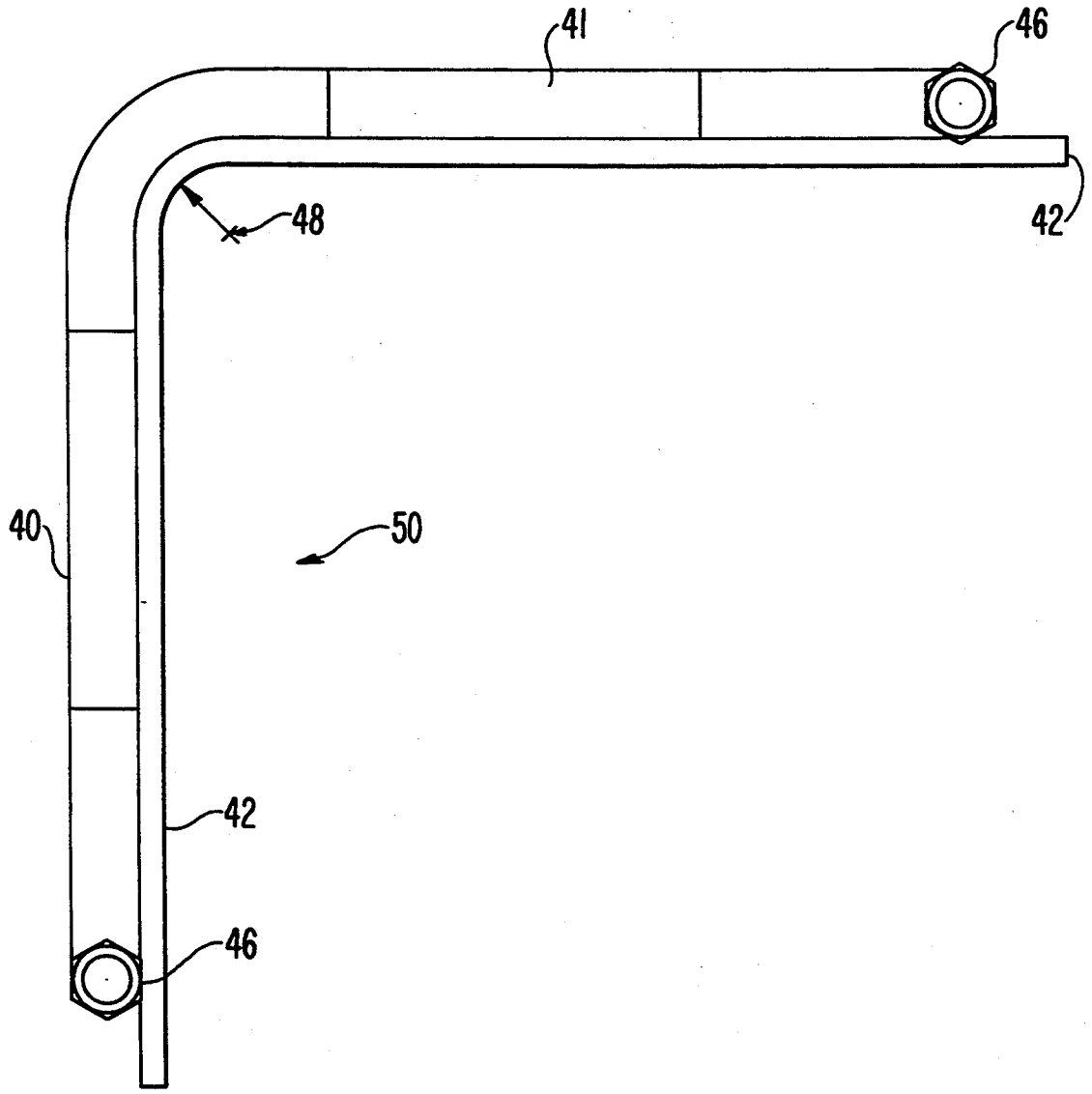
FIG. 5 is a side cross-sectional view of the member of FIG. 4 after bending, for use in forming a tap-hole channel in a blast furnace.

The fluid-conducting member 38 preferably includes a heat-conductive wall 44, such as a copper tube, in juxtaposition with a surface of the heat-conductive member 36 and attached by suitable means, such as welding. In FIG. 4, the fluid-conducting member 38 is in a serpentine form to minimize the number of fluid connectors 46 at the respective ends of the member 38. Other configurations of the member 38 adjacent to the heat-conductive member 36 are possible. A side view of the cooling member 34 is shown in FIG. 5.

A bend line is shown in FIG. 4 at the reference numeral 48. The heat-conductive member 36 and the fluid-conductive member are bent at about the bend line 48 to form an L-shaped member 50 having a bending radius of about 1 inch. The L-shaped member 50 thus formed is used when relining the cupola 10 to form a channel in which the tap-hole 23 is formed.

Figure 6:
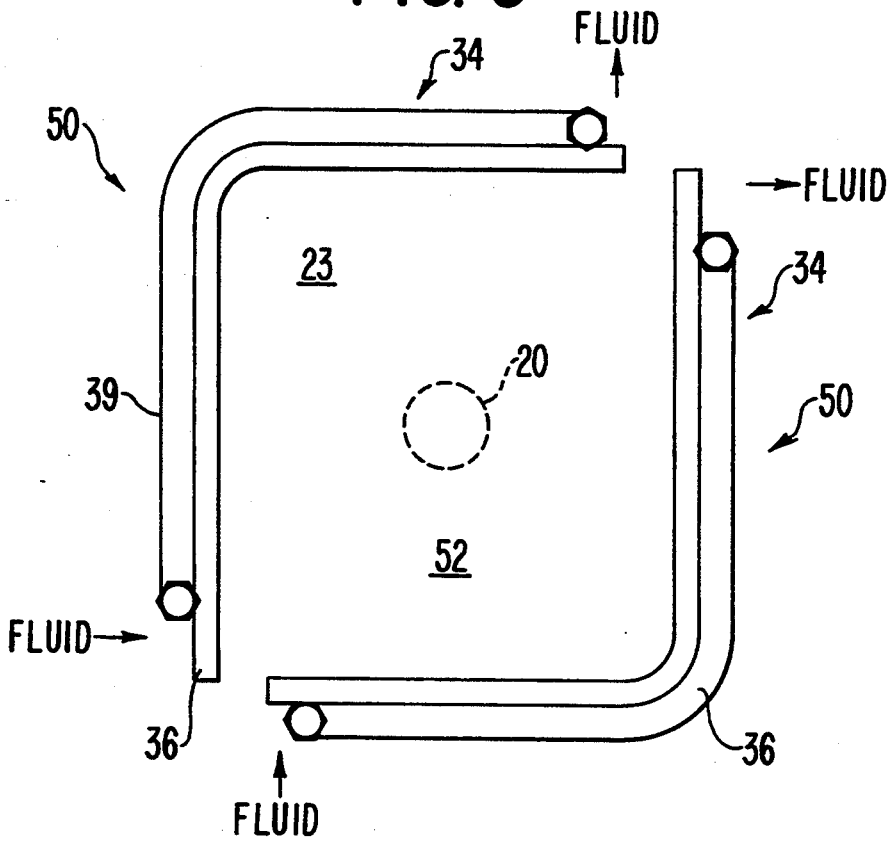
FIG. 6 is a diagrammatic side cross-sectional view of a pair of bent members as shown in FIG. 5, thus forming a channel therebetween for formation of a tap-hole.

A pair of L-shaped members 50 are shown in FIG. 6, positioned so that the ends of the adjacent legs of the L are approximately adjacent one another to form a channel 52 intermediate the L-shaped members 50.

Figure 7:
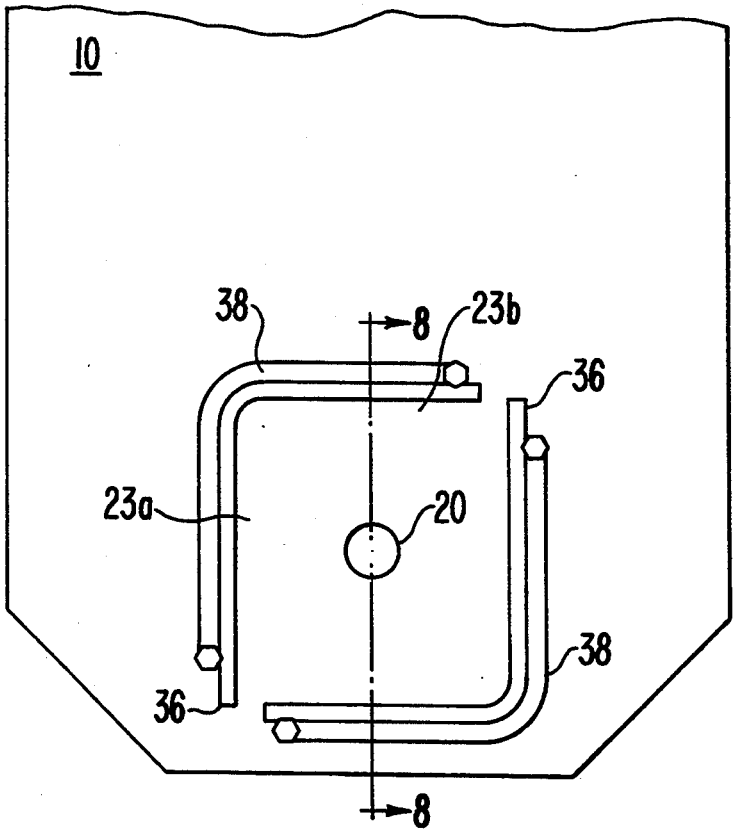
FIG. 7 is a frontal, partial cross sectional view of a portion of the cupola having a tap-hole formed intermediate refractory located in the channel formed by a pair of the members of FIG. 5, as seen in FIG. 6.
Figure 8:
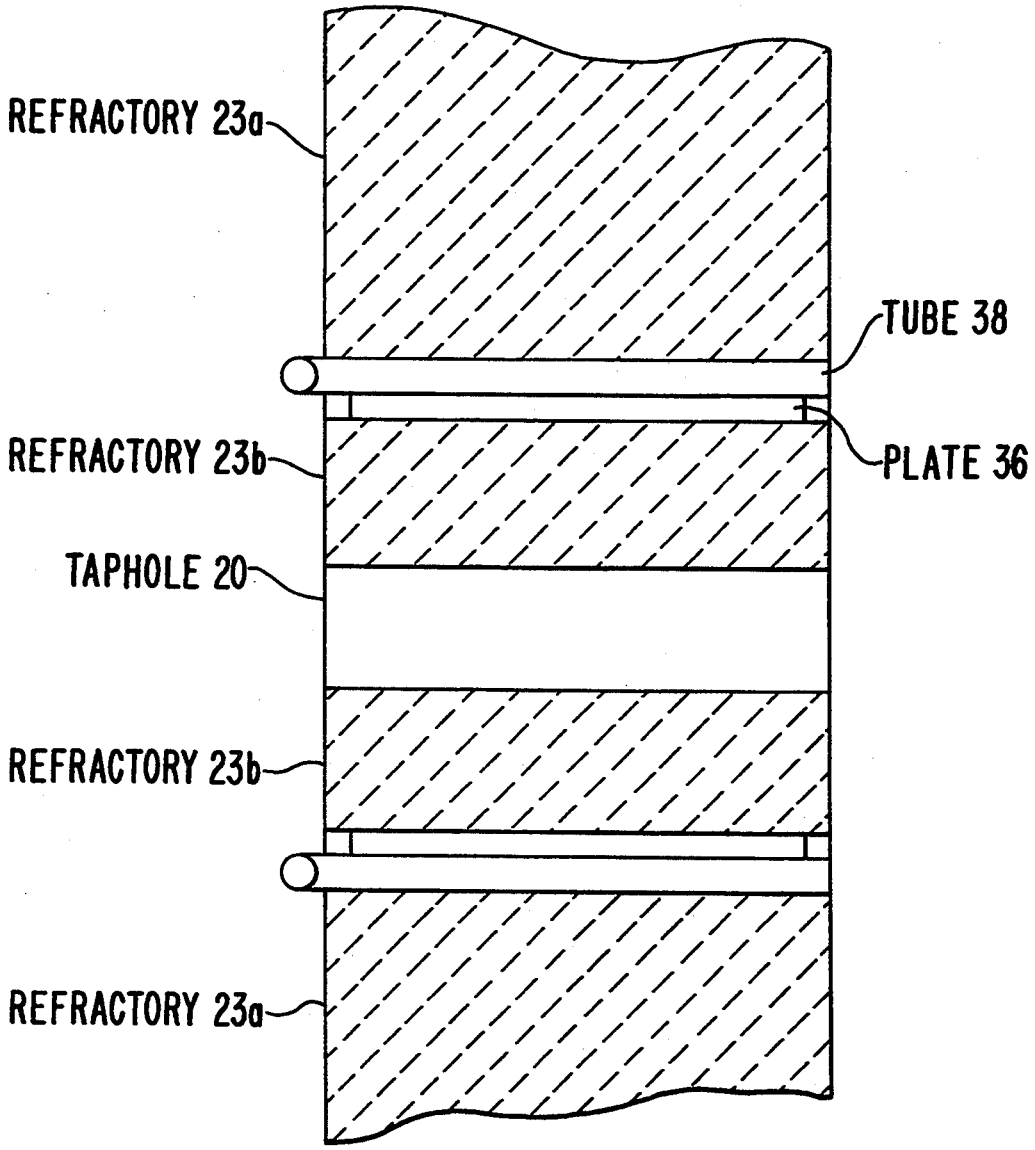
FIG. 8 is a partial side cross-sectional view taken along line 8—8 of FIG. 7.

FIG. 7 shows a front view of a cupola 10 as relined by positioning a pair of L-shaped members 50 as shown in FIG. 6 to form the channel 52. The exterior of the members 50 is relined with refractory **23*a*, while the channel area 52 is relined with refractory 23*b* to form the tap-hole 20. The tube ends are positioned to exit away from the interior of the cupola so that fluid, such as water, can be readily connected. When so constructed, the members 50 are positioned about 12 to 18 inches from the tap-hole 20. When so positioned, and when supplied with water as a coolant, the life of the respective adjacent refractories 23*a* and 23*b*** is extended, reducing the need for tap-hole reformation and relining in the tap-hole area.

Figure 9:
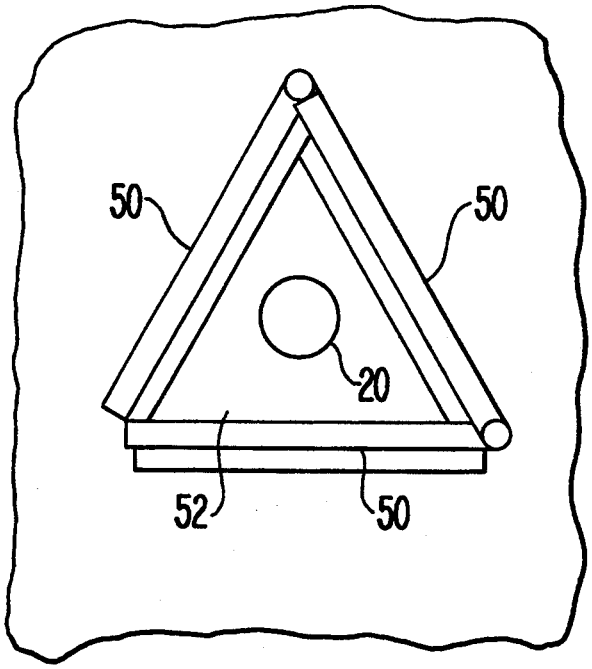
FIG. 9 is a partial frontal view of another embodiment wherein three of the members of FIG. 4 are arranged in a triangular configuration to form a triangular channel for a tap-hole.

FIG. 9 illustrates an alternate embodiment where three L-shaped members 50 are arranged in a triangular cross-sectional configuration to form the channel 52 therein as in the case of FIG. 6 where the tap-hole 20 is formed. In operation and in installation, the structure is the same in principle.

Figure 10:
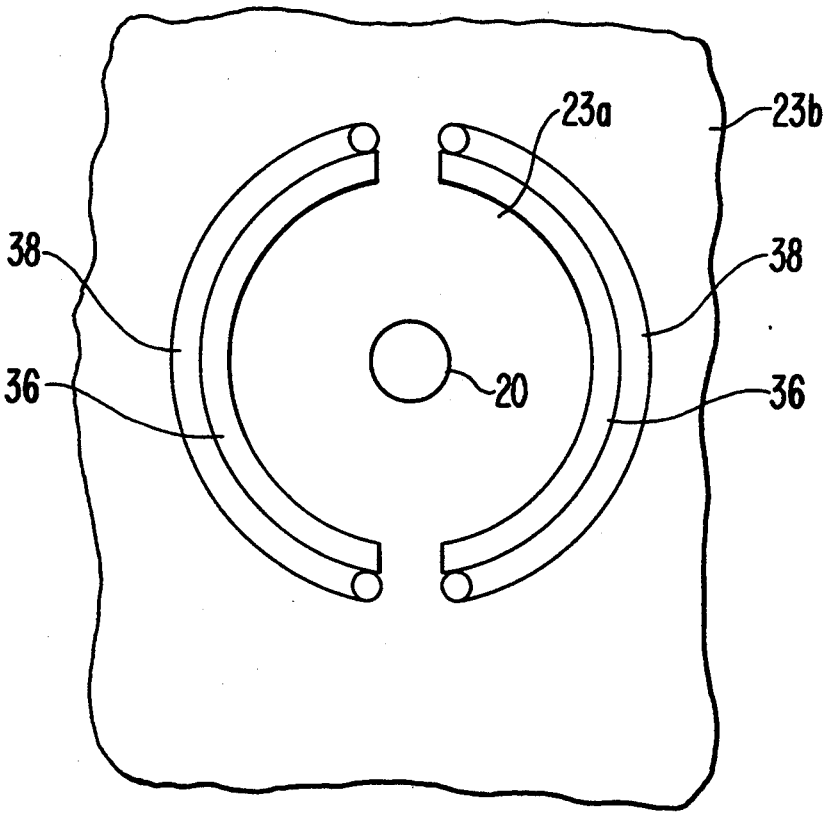
FIG. 10 is partial frontal view of another embodiment wherein the members of FIG. 4 are formed into a semi-circular shape so that a pair of such members form a channel for a tap-hole in the cupola.
Figure 11:
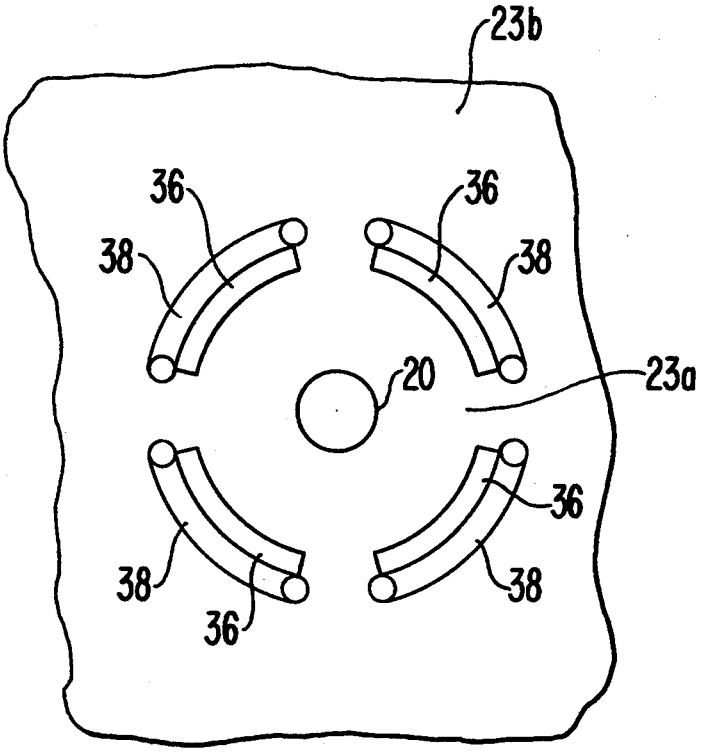
FIG. 11 is still another partial frontal view of another embodiment wherein a plurality of the members of FIG. 4 are formed into arcuate sectors for forming the tap-hole channel.

FIG. 10 illustrates an embodiment wherein the cooling member 34 is formed in a semicircular configuration, thus forming the channel 52 intermediate a pair of such semicircular members. FIG. 11 shows a similar embodiment having four of such members 34 formed in sectors to define a channel. FIG. 11 is less preferred because the number of tube end connections required is increased.

What is claimed is:

1. A cupola, comprising:

a charging opening for receiving materials into said cupola;

a tap-hole formed in a sidewall of said cupola through which molten material exits from said cupola, said tap-hole being separate from said charging opening;

a heat-conductive member comprising a plate having opposed ends and a thickness;

a fluid-conducting member secured to said heat-conductive member, said fluid-conducting member comprising a heat-conductive tube secured to said plate and having ends structurally adapted for connection to a source of heat-conducting fluid, a structural combination of said heat-conductive member and said fluid-conducting member together forming a cooling member, at least one such cooling member defining at least in part a channel in said sidewall of said cupola in which said tap-hole is formed, said channel being filled with refractory to define said tap-hole.

2. The apparatus as set forth in claim 1, wherein said cooling member is bent about a bend line to form an L-shaped member, at least one L-shaped member being used in a cupola to form said channel in said cupola sidewall by intermediate legs of said L.

3. The apparatus as set forth in claim 2, wherein a plurality of said L-shaped members are used to form said channel in said cupola sidewall.

4. The apparatus as set forth in claim 1, wherein a plurality of said cooling members are used to define said channel in said cupola sidewall.

5. The apparatus as set forth in claim 4, wherein each of said cooling members is formed in a semicircular configuration to form said channel in said cupola sidewall.

6. The apparatus as set forth in claim 4, wherein each of said cooling members is formed in an arcuate configuration to form said channel in said cupola sidewall.

7. An apparatus comprising:

a cupola having a charging opening for receiving material into said cupola, a refractory wall defining a tap-hole area and having a thickness, and a tap-hole extending through said thickness in said tap-hole area separate from said charging opening for allowing molten material to exit from said cupola, said tap-hole being separate from said charging opening;

a cooling member positioned along said thickness in said refractory wall adjacent said tap-hole area, said cooling member having a heat-conductive member and a fluid-conducting member together forming said cooling member, at least one such cooling member defining at least in part a channel through at least a portion of said refractory wall in which said tap-hole is formed, refractory being positioned to form said cupola wall thickness adjacent each side of said cooling member, said cooling member being spaced from said tap-hole formed by said refractory; and means cooperating with said fluid conducting member for receiving fluid therein.

8. The apparatus as set forth in claim 7, further including a plurality of such cooling members to form said channel through said refractory wall for said tap hole.

9. The apparatus as set forth in claim 8, wherein said plurality of said cooling members are arranged in a triangular configuration, said triangular configuration lying intermediate said cupola wall and defining said channel through said refractory wall for said tap-hole within said triangular configuration, refractory being provided on each side of each of said plurality of cooling members.

10. The apparatus as set forth in claim 8, wherein each of said cooling members is formed as a planar member and is bent into an L-shape, a pair of L-shaped members having legs adjacent one another to define said channel through said refractory wall within said pair of L-shaped members, said pair of L-shaped members being located within said refractory wall of said cupola.

11. The apparatus as set forth in claim 8, wherein each of said plurality of said cooling members has an arc-shaped configuration.

12. A method for cooling a tap-hole extending through a thickness of a refractory wall of a cupola separate from a charging opening of said cupola, comprising the steps of:

providing a cooling member along said thickness of said refractory wall at a location spaced from a tap-hole location, said cooling member having a heat-conductive member and a fluid-conducting member in contact with said heat-conductive member;

providing refractory adjacent said cooling member to locate said cooling member in said refractory wall to define a channel at said tap-hole location; and providing refractory adjacent another side of said cooling member to form said tap-hole in said channel, whereby said tap-hole is effectively fluid-cooled.

* * * * *